US005669500A

United States Patent [19]

Sutherland

[11] Patent Number: 5,669,500

[45] Date of Patent: Sep. 23, 1997

[54] CARRIER FOR STACKED BOTTLES

[75] Inventor: Robert L. Sutherland, Kennesaw, Ga.

[73] Assignee: Riverwood International Corporation, Atlanta, Ga.

[21] Appl. No.: 588,797

[22] Filed: Jan. 19, 1996

[51] Int. Cl.[6] ..... B65D 65/00; B65B 5/10; B65B 35/50

[52] U.S. Cl. ..... 206/427; 53/447; 53/467; 53/491; 706/478; 229/103.2

[58] Field of Search ..... 206/427, 428; 229/103.2, 109, 112, 171, 172, 174, 182; 53/447, 467, 491, 376.4, 377.2

[56] References Cited

U.S. PATENT DOCUMENTS

| | | | |
|---|---|---|---|
| 3,900,104 | 8/1975 | Harned | 229/112 X |
| 4,029,207 | 6/1977 | Gordon | 206/427 |
| 4,216,861 | 8/1980 | Oliff | 206/427 |
| 4,482,090 | 11/1984 | Milliens | 229/103.2 X |
| 4,582,199 | 4/1986 | Schuster | 206/428 |
| 4,744,507 | 5/1988 | Morsbach | 229/103.2 X |

*Primary Examiner*—Bryon P. Gehman

[57] ABSTRACT

A package comprised of a sleeve-type carrier containing stacked layers of bottles. The end panels, which include upper tapered portions to accommodate the necks of adjacent bottles, are formed partially of major and minor end panel flaps connected to the side panels. The minor end panel flaps are in the tapered area, as are upwardly extending flaps of the major end panel flaps. Tapered portions in the side panels are also provided for, if desired. Recesses in the minor end panel flaps avoid interference with the upwardly extending flaps of the major end panel flaps. The recesses are also shaped so that the minor end panel flaps do not interfere with a bottle restraining rail during formation of the end panel.

8 Claims, 4 Drawing Sheets

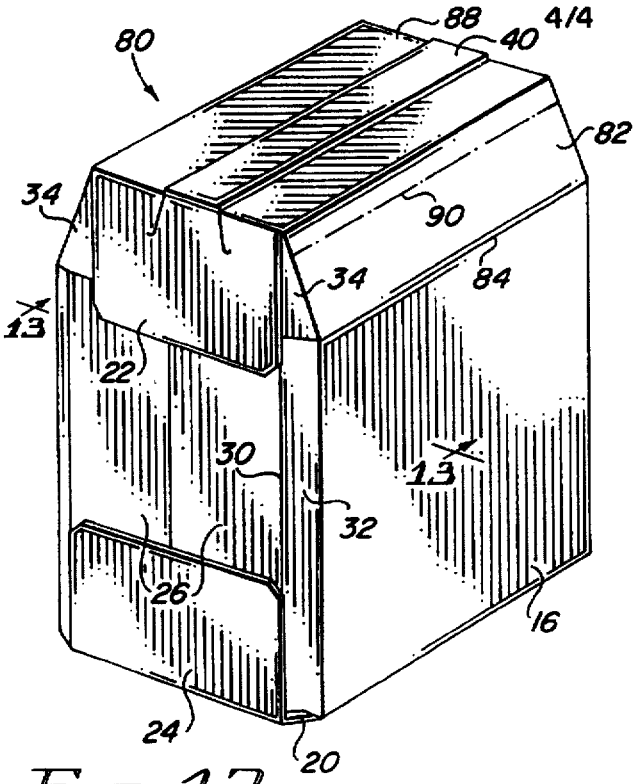
FIG. 12
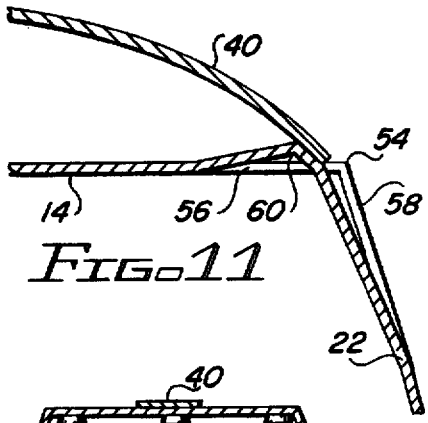
FIG. 11
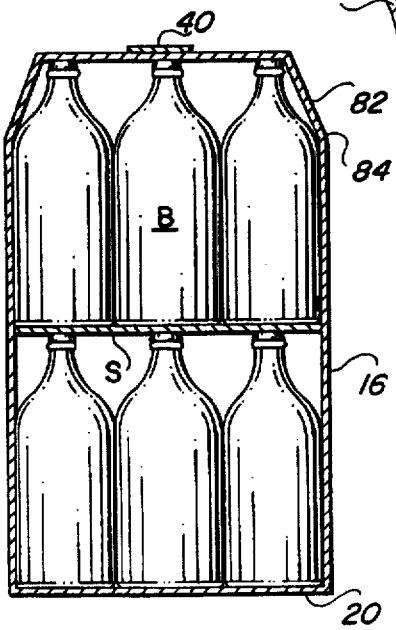
FIG. 13
FIG. 14
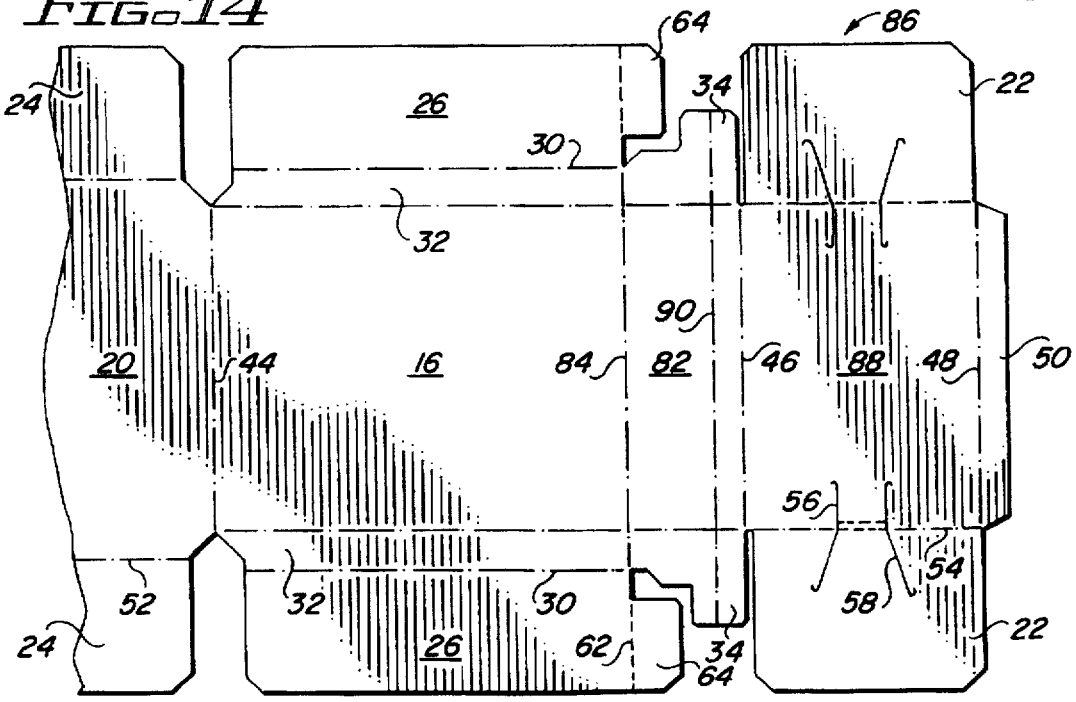

CARRIER FOR STACKED BOTTLES

FIELD OF THE INVENTION

This invention relates to carriers which contain a plurality of layers of articles in stacked relationship. More particularly, it relates to a carrier of this type which is designed to accommodate bottles.

BACKGROUND OF THE INVENTION

Sleeve-type carriers have long been used to package beverage containers and other articles. To form a package the top, bottom and side panels of the carrier are connected to form an open-ended sleeve configuration. The articles to be packaged, such as beverage cans, are loaded through one or both of the open ends so that their axes are parallel with the bottom panel and their ends abut the side panels of the carrier. The end panels of the carrier are then formed from flaps connected to the ends of the sleeve.

Sleeve-type carriers have more recently been designed to hold two layers of beverage cans in stacked relationship as a way of more efficiently packaging greater numbers of cans. In such an arrangement the cans are inserted into the carrier sleeve with their axes parallel to the side panels, so that the lower ends of the cans in the bottom layer abut the bottom panel and the upper ends of the cans in the upper layer abut the top panel. Again, the end panels are formed from flaps connected to the ends of the sleeve.

Although it would be desirable to package beverage bottles in the same manner, the contour of the bottles makes this difficult. To tightly hold the upper layer of bottles in place the upper portions of the end panels should be inwardly tapered so as to lie adjacent the necks of the end bottles. Difficulties are encountered, however, in designing end panel flaps which will accommodate such a shape while at the same time permitting the bottles to be held in place while the end panels are being formed.

It is therefore an object of the invention to provide a carrier capable of securely holding two layers of bottles or other tapered articles. Another object is to provide a carrier of this type whose end panels can be formed rapidly and efficiently while the end bottles are held in place.

BRIEF SUMMARY OF THE INVENTION

The invention makes use of a carrier comprising a top panel, a bottom panel, opposite side panels and opposite end panels connected together to form an enclosure. Each end panel is comprised of two relatively long major end panel flaps and two relatively short minor end panel flaps, all the flaps being connected by fold lines to the side panels. In addition, an upper end panel flap is foldably connected to the top panel and a lower end panel flap is foldably connected to the bottom panel. Each minor end panel flap is located above an associated major end panel flap and tapers outwardly from the top panel. The end panels additionally are comprised of the lower end panel flaps overlapping portions of associated major end panel flaps and the upper end panel flaps overlapping portions of associated major and minor end panel flaps.

To accommodate the tapered upper end panel portions, the fold lines connecting the minor end panel flaps to the side panels form an angle with the fold lines connecting the major end panel flaps to the side panels. Preferably, the major end panel flaps include a further upper flap which is part of the tapered portion of the end panels. The minor end panel flaps include a recess into which a portion of the associated major end panel flap extends. The recess is also shaped so as to allow the minor end panel flaps to be folded into place without interference from a machine rail which is employed to hold the end bottles in place during the folding process.

The major end panel flaps are also preferably provided with bevel panels which better conform to the contour of adjacent articles in the package. A transverse fold line may also be provided in the side panels to form tapered upper portions in the side panels as well as in the end panels. Provision is also made for a handle strap adapted to lie flat on the top panel so as not to interfere with the stacking of carriers for shipment.

The carrier is structurally sound and can be economically formed, making it practical to package more than one layer of bottles or other articles in a carrier. These and other features and aspects of the invention, as well as other benefits, will readily be ascertained from the detailed description of the preferred embodiments described below.

BRIEF DESCRIPTION OF THE DRAWINGS

FIG. 11 is an enlarged partial transverse sectional view through an end of the handle strap, showing the strap in use;

FIG. 12 is a pictorial view similar to that of FIG. 1, but showing a modified carrier;

FIG. 13 is a longitudinal sectional view of the carrier taken on line 13—13 of FIG. 12; and FIG. 14 is a partial plan view of a blank for forming the carrier of FIG. 12.

DETAILED DESCRIPTION OF THE PREFERRED EMBODIMENTS

Figure 1:
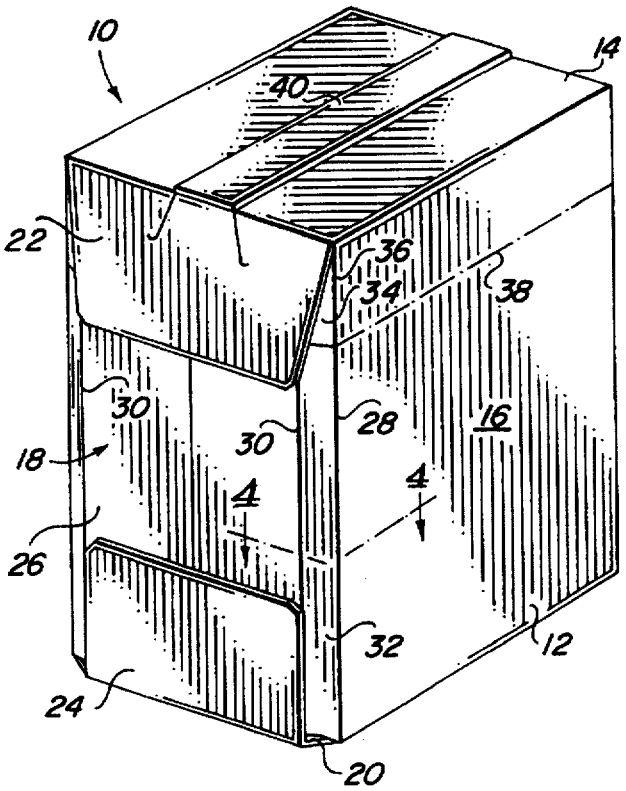
FIG. 1 is a pictorial view of a sleeve-type carrier of the present invention.
Figure 2:
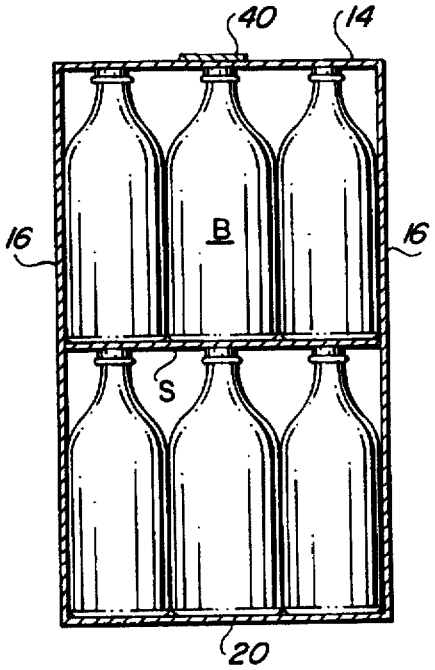
FIG. 2 is a longitudinal sectional view taken on line 2—2 of FIG. 3.

Referring to FIGS. 1 and 2, the package 10 is comprised of sleeve-type carrier 12 adapted to contain two layers of bottles B. In the package illustrated, the bottles in the upper layer are aligned with the bottles in the lower layer and are separated from them by a sheet or pad S, with the upper ends of the bottles in the upper layer abutting the top panel and the bottoms of the bottles in the lower layer abutting the bottom panel. Each layer is made up of three rows of four bottles each, so that the package contains twenty-four bottles arranged in two stacked layers.

Figure 3:
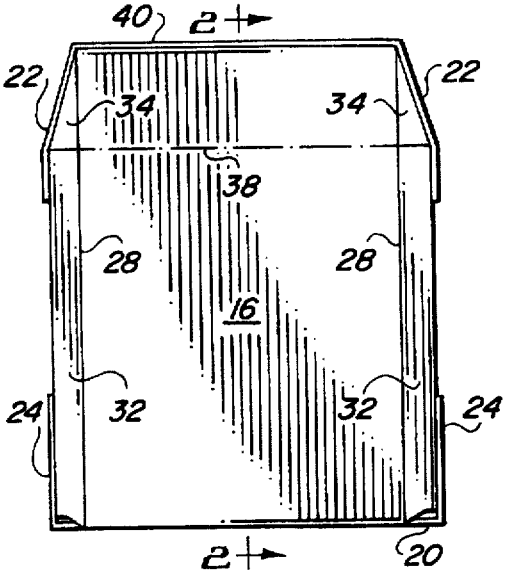
FIG. 3 is a side view of the carrier of FIG. 1.
Figure 4:
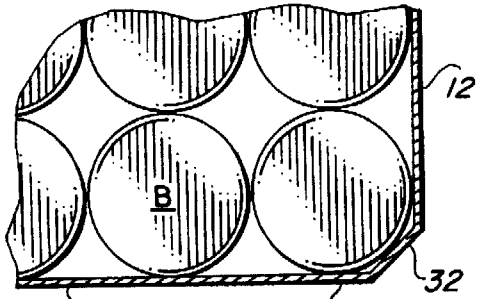
FIG. 4 is a partial sectional view taken on line 4—4 of FIG. 1.

As best shown in FIGS. 1 and 3, the carrier includes a top panel 14, side panels 16, end panels 18 and bottom panel 20. Upper and lower end panel flaps 22 and 24, which are foldably connected to the top and bottom panels, respectively, are glued to elongated major end panel flaps 26 to form the end panels. The major end panel flaps 26, which meet at the centerline of the carrier, are connected to the side panels by fold lines 28 and include fold lines 30 spaced from and parallel to the fold lines 28. The spaces between the fold lines 28 and 30 form bevel panels 32 which allow the corner areas of the carrier to more closely conform to the contour of adjacent bottles, as illustrated in FIG. 4. Also forming part of the end panels are minor end flaps 34 which are connected to the side panels along fold lines 36 and which serve functions explained in more detail below. The side panels also include a score line 38 extending between the intersections of the fold lines 28 and 36. A carrying strap 40 connected at the ends of the top panel serves as a handle for the carrier.

As shown in FIGS. 1 and 2, the top and bottom panels are of the same width, so that the side panels lie in an essentially vertical plane. As shown in FIGS. 1 and 3, the length of the bottom panel is greater than the length of the top panel, causing the upper end flaps 22 to extend at an angle approximating the angle between the barrel and necks of adjacent bottles, thereby allowing the end panels to more closely follow the contour of the end bottles in the upper layer. The tops or caps of the end bottles in this arrangement are adjacent the ends of the top panel.

Figure 5:
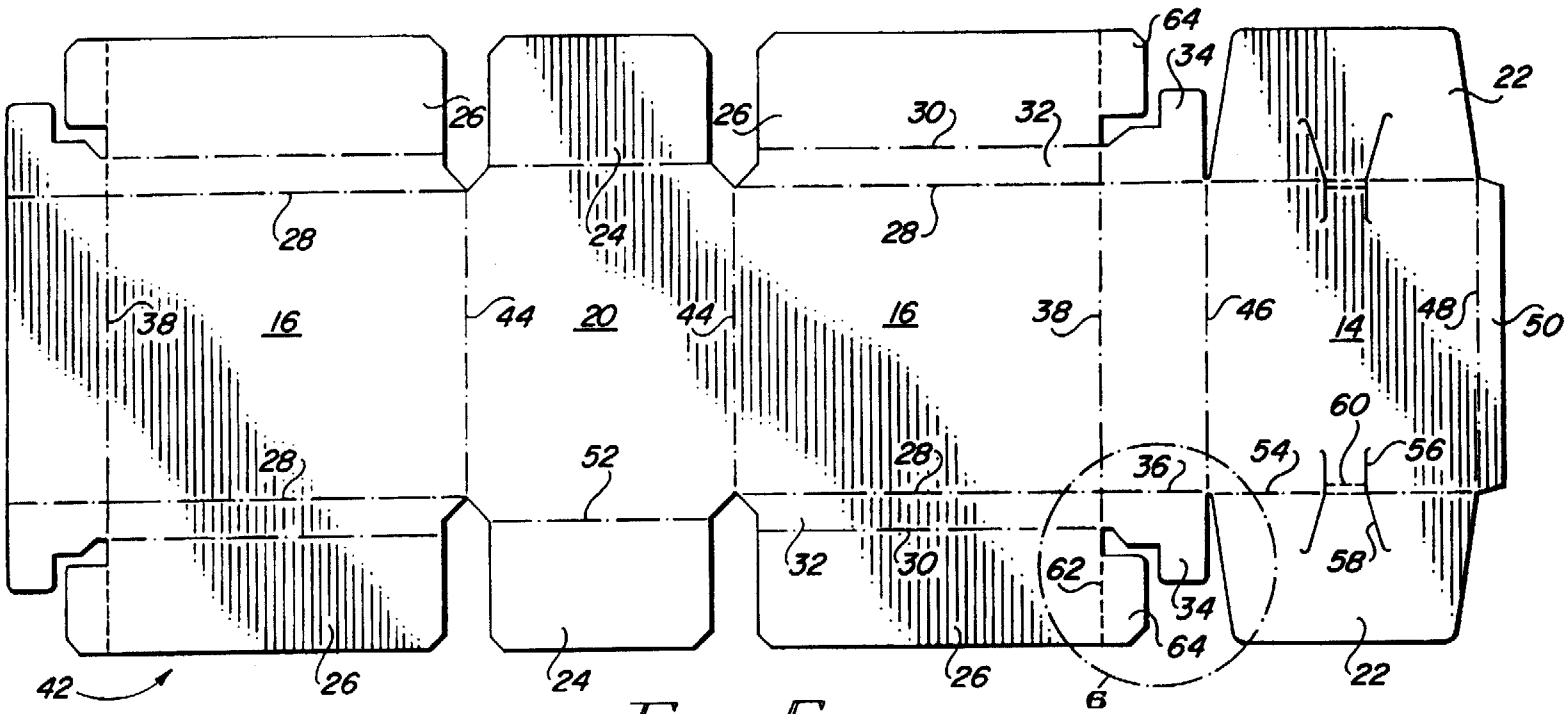
FIG. 5 is a plan view of a blank for forming the carrier of FIG. 1.

Referring to FIG. 5, a blank 42 for forming the carrier is comprised of paperboard or other material having sufficient strength and flexibility to be folded into place and to function as carrier material. Bottom panel section 20 is connected on opposite sides by fold lines 44 to side panel sections 16, one of which is at the end of the blank and the other of which is in the interior of the blank. The interior side panel section 16 is connected by fold line 46 to top panel section 14, which in turn is connected by fold line 48 to glue flap 50.

Connected to the ends of bottom panel section 20 by fold lines 52 are the lower end panel flaps 24. The upper end panel flaps 22 are similarly connected to the top panel section 14 by fold lines 54. Relatively short parallel slits 56 at opposite ends of the top panel section 14 cross the fold lines 54 and extend into the end panel flaps 22 as diverging slits 58. Each slit preferably terminates in an arcuate end to resist tearing. Parallel to and spaced a short distance from each fold line 54 is fold line 60, which extends between the adjacent pair of slits 56. The purpose of the fold line and the slits is explained more fully below.

Figure 6:
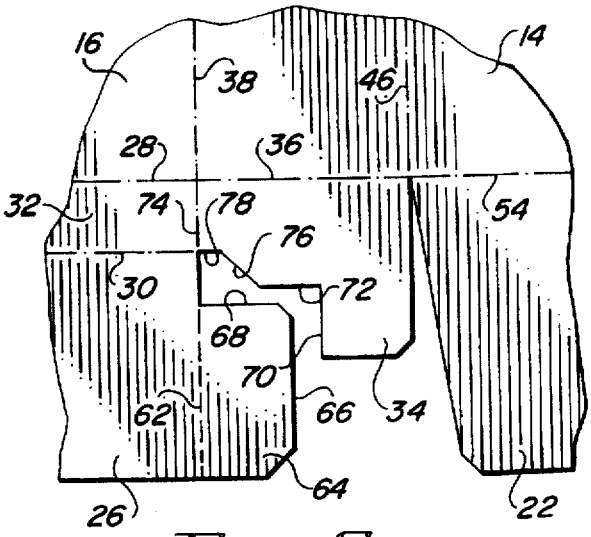
FIG. 6 is an enlarged plan view of the area within the circle 6 of FIG. 5.

The major end panel flaps 26 are connected to the side panel sections by the fold lines 28. Connected to each major end panel flap 26 by fold line 62 is a flap extension 64. As shown in FIG. 6, the flap extensions include edges 66 and 68 which extend at right angles to each other. The adjacent minor end panel flap 34 is recessed or cut away to form edges 70 and 72 which are spaced from and parallel to the edges 66 and 68, respectively. The minor end panel flap 34 is separated from the major end panel flap 26 by slit 74, which is aligned with the fold lines 38 and 62. Diagonal edge 76 of the minor flap 34 extends to a short edge 78 aligned with the fold line 30. The contour of the minor end panel flaps 34 causes the flaps to be spaced from the flap extensions 64. It will be noted that the fold lines 36 connecting the minor end panel flaps 34 to the side panel sections 16 form a slight angle with the fold lines 28 and 54. The fold lines 54, therefore, while parallel to the fold lines 28, are not aligned with them.

Figure 7:
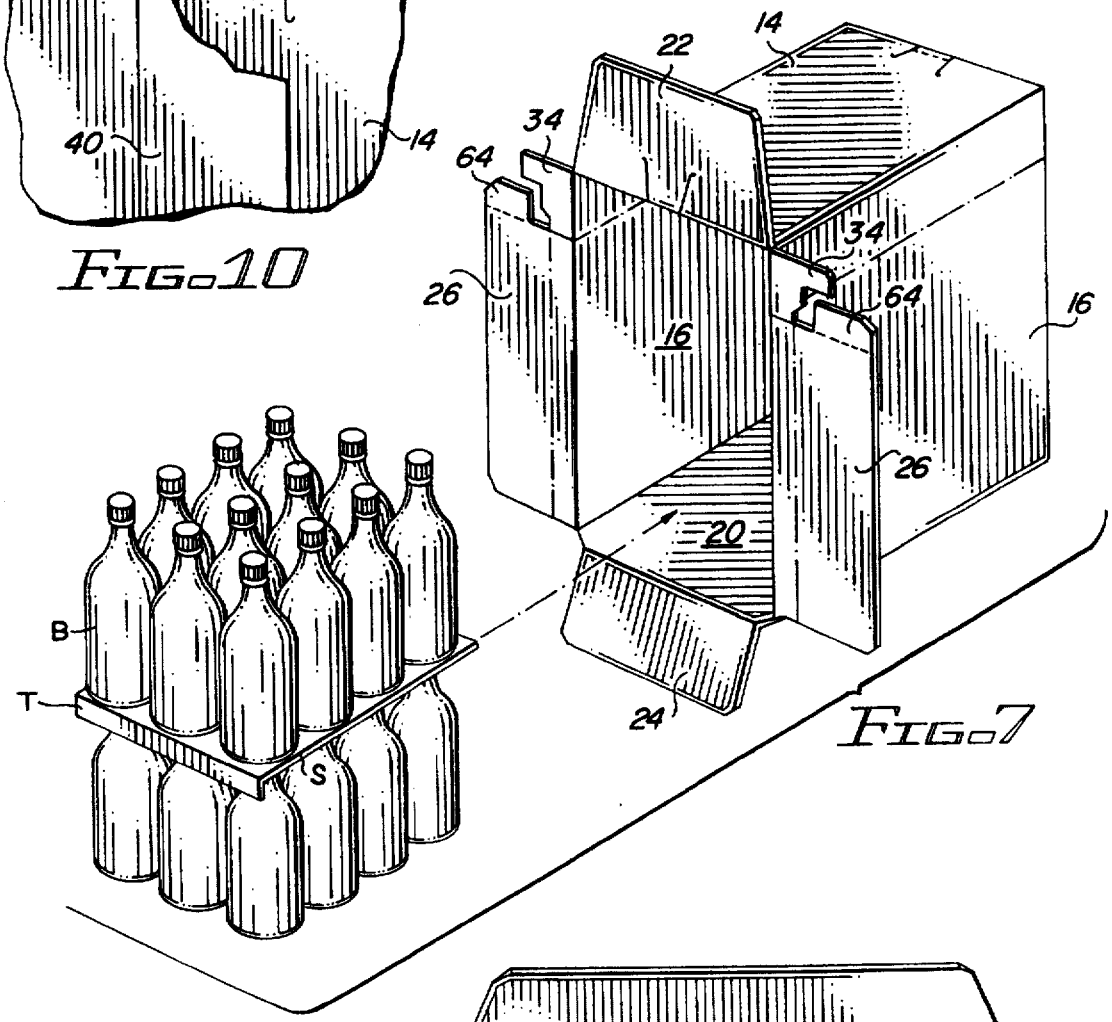
FIG. 7 is a pictorial view of an open-ended carrier in the process of being loaded with bottles.

To form a carrier from the blank the top, bottom and side panel sections are folded along the fold lines 44 and 46 to form a rectangular sleeve configuration and the glue strip 50 is adhered to the folded opposite side panel section 16 to secure the structure in place. Typically, the sleeves so formed are shipped in collapsed form to a packaging plant where the sleeves are erected and the fabrication process is continued. Two layers of bottles are then introduced through an open end of the erected sleeve, as schematically illustrated in FIG. 7. It will be understood that the end panel flaps are held in open position during introduction of the bottles by well known packaging machine elements, not shown. The bottles are stacked as previously described, with the separator sheet S between the two layers. The sheet S preferably includes a tab T which is useful in several respects. Instead of the bottles in the upper layer being slid into place over an edge of the sheet, they are slid over the fold of the tab, thereby avoiding the possibility of the bottles being snagged by the edge and upset as they are moved into place on the sheet. The tab also facilitates handling the sheet and provides extra rigidity to the carrier if the tab is adhered to the adjacent end panel.

Figure 9:
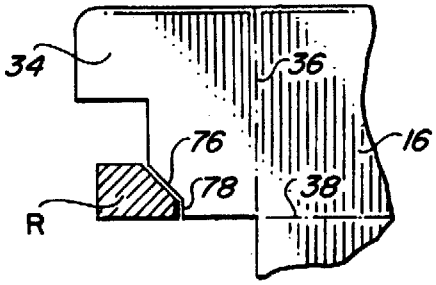
FIG. 9 is a transverse sectional view through a machine guide rail, showing the relationship between the rail and the opened minor end flaps of the carrier.
Figure 8:
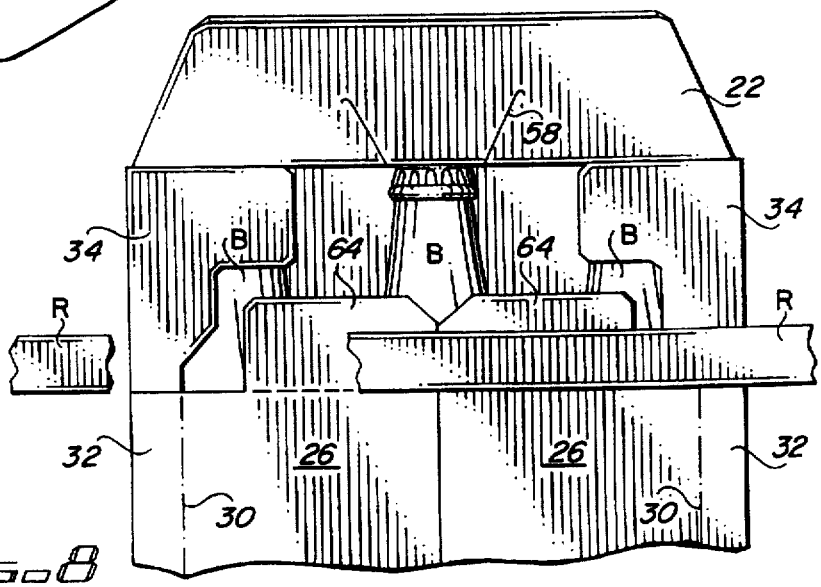
FIG. 8 is a partial end view of the carrier shown in relation to a packaging machine guide rail at an interim stage of carrier formation.

After the bottles are inserted the major end panel flaps 26 are folded in and the lower end flaps 24 are glued to them. The minor end flaps 34 are then folded into place, after which the upper end panel flaps 22 are folded down and glued to the major and minor end flaps. During this process, because the bottles are tightly packed, the end bottle in the middle row tends to be squeezed out as the end panels are formed. To prevent this from occurring a machine guide rail R, shown in FIG. 8, is provided to restrain the bottles against outward movement prior to pivoting the upper end panel flap 22 into position. It will be understood that the upper end panel flap 22 is folded into place at a location on the packaging machine just downstream from the end of the guide rail so that the guide rail does not interfere with this operation. As illustrated in FIG. 9, the recess in the minor end panel flaps 34 provided by the edges 76 and 78 allows the flaps 34 to clear the guide rail as they are folded to their final position, thus allowing the guide rail to continue to stabilize the end bottles during this phase of the end panel forming process.

As noted above, the fold line 36 connecting the minor end panel flaps 34 to the side panel 16 forms a slight angle with the major end panel flap fold line 28 so that it is angled slightly from the vertical. This assists in the ability of the minor end panel flaps to assume an angular relationship with the top panel 14, as required by the outwardly angled upper portions of the end panels. Because the flaps 64 are connected to the major end panel flaps 26 by fold line 62, they are also capable of following the angled contour of the upper portions of the end panels. The further recessed portion of the minor end panel flaps 34 formed by edges 70 and 72 allow the minor end panel flaps to be folded into place without interference from the flaps 64 of the major end panel flaps.

Although the side panels 16 are substantially vertical throughout, the score line 38 permits flexing in the side panels in the area adjacent the crowns of the bottles in the outer rows during loading of the bottles.

Figure 10:
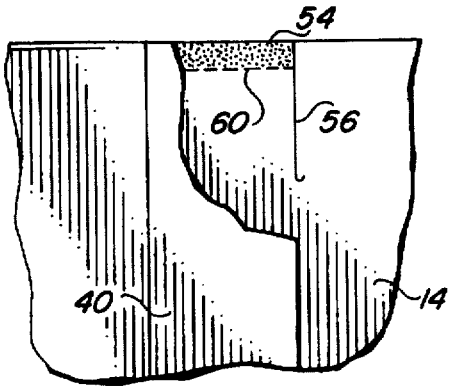
FIG. 10 is an enlarged partial top plan view of the carrier of FIG. 1, with part of the handle strap removed.

After the carrier has been formed the handle strap 40 is applied. As shown in FIGS. 1–3, the strap is essentially the same length as the carrier and lies flat against the top panel. This arrangement allows the carriers to be stacked for shipping without interference from the strap. As shown in FIG. 10, the ends of the strap are glued to the portion of the top panel lying between the top panel fold line 54 and the short fold line 60. As the handle strap is raised up when used to lift the carrier the ends of the strap are caused to move toward each other, which is made possible by the slits 56 and 58 and by the short fold line 60. FIG. 11 illustrates this process, whereby the portions of the end panels between the slits 58 are forced inward, the portions of the top panel between the slits 56 are forced upward and the fold line 60 allows the top panel portions to adjust to the new angle of the handle ends.

Another embodiment of the invention is indicated by reference numeral 80 in FIGS. 12 and 13, wherein like reference numerals to those used in connection with the first embodiment denote similar elements. The side panels 16 of the carrier include an upper bevel panel portion 82 connected to the vertical portion by fold lines 84. This allows the side edges of the top panel to lie adjacent the tops of the bottles B to more tightly hold the bottles in place. The angled upper portions of the side panels are thus consistent with the angled upper portions of the end panels to provide a tapered configuration on both the end panels and side panels.

The blank from which the carrier is formed is similar to the blank of FIG. 5 except for two modifications which are shown in FIG. 14. In the modified blank 86 the top panel section 88 is narrower than the top panel section of the blank of FIG. 5 as explained above. Also, the bevel panel portion shown in FIG. 14 includes score line 90. Due to the narrower top panel section, when forming a flat collapsed carrier it is not possible to fold the blank about the fold line 46, as in the case of the blank of the first embodiment, since the glue flap 50 would not then reach the other end of the folded blank. By folding the blank about the score line 90, the glue flap 50 can be adhered to the other end of the folded blank as in the first embodiment to form a flat collapsed carrier. This score line is a working score line only, in that it is employed as explained but does not function as a fold line in the carrier. It is merely present in the straight beveled portion of the carrier, as shown in FIG. 12, after the beveled portion has been formed by the fold lines 84 and 46. The score line does not detract from the strength of the carrier since the bottles fit tightly in the carrier, as described above, giving no opportunity for the beveled portion to be folded about the working score.

The invention allows bottles to be packaged in two layers in carriers which can be formed with either a two-sided or four-sided tapered configuration capable of tightly holding the layers of bottles in place. In addition, provision has been made to hold in the end bottles in the middle row during packaging without interfering with the ability to provide tapered upper end portions.

Obviously, although the invention has been described in connection with a carrier designed to hold twelve beverage bottles in each layer, the principles of the invention may be incorporated in carriers designed to hold different numbers of bottles. Also, the invention is not limited to the packaging of beverage bottles, but may be employed to package other types of articles of generally similar shape. Because the invention is not necessarily limited to all the specific details described in connection with the preferred embodiments, except as they may be within the scope of the appended claims, changes to certain features of the preferred embodiments which do not alter the overall basic function and concept of the invention are contemplated.

What is claimed is:

1. A package comprised of an article carrier containing upper and lower layers of similar adjacent articles arranged in upright position, each article having a relatively narrow top connected by a tapered portion to a relatively wide body, the carrier comprising:

a top panel, a bottom panel, opposite side panels and opposite end panels connected together to form an enclosure for the layers of articles;

each end panel being comprised of two relatively long major end panel flaps, each major end panel flap being connected by a first fold line to a different one of the opposite side panels, two relatively short minor end panel flaps, each minor end panel flap being connected by a second fold line to a different one of the opposite side panels, an upper end panel flap connected by a fold line to the top panel and a lower end panel flap connected by a fold line to the bottom panel;

each second fold line being located above an associated first fold line and each minor end panel flap being located entirely above an associated major end panel flap, the minor end panel flaps being separate from and unconnected to the major end panel flaps;

each of the first fold lines having an upper end and each major end panel flap including a third fold line lying in a plane which substantially extends through the upper ends of the first fold lines;

each major end panel flap including a further flap connected to the third fold line, said further flap being spaced from and unconnected to the first fold line, said further flap forming part of the associated outwardly tapered end panel portion;

each lower end panel flap overlapping portions of the associated major end panel flaps and being adhered thereto;

each upper end panel flap overlapping portions of the associated major and minor end panel flaps and being adhered thereto; and the second fold lines and portions of the end panels located above the first fold lines tapering outwardly from the top panel.

2. A package as defined in claim 1, including a handle strap, a pair of slits in each upper end flap extending into adjacent portions of the top panel, a short fold line in the top panel extending between each pair of slits therein, opposite end portions of the handle strap being adhered to opposite end portions of the top panel between the short fold lines and the associated upper end panel flap.

3. A package as defined in claim 1, wherein the carrier contains two layers of beverage bottles, each layer being comprised of three rows of bottles, each row extending lengthwise of the carrier, the bottles in the upper layer being aligned with the bottles in the lower layer, the package including a substantially horizontal sheet separating the bottles in the upper layer from the bottles in the lower layer, and the further flaps of the major end panel flaps being adjacent the tapered portions of adjacent bottles in the upper layer.

4. A method of forming a package comprised of an article carrier containing a plurality of layers of similar adjacent articles arranged in upright position, each article having a relatively narrow top connected by a tapered portion to a relatively wide body, the upper layer containing three rows of articles extending parallel to the length of the carrier, comprising:

providing a carrier including a top panel, a bottom panel, opposite side panels and opposite ends, at least one of the ends being open, two relatively long major end panel flaps connected by first fold lines to the opposite side panels at the open end of the carrier, two relatively short minor end panel flaps connected by second fold lines to the opposite side panels at said open end, an upper end panel flap connected by a fold line to the top panel at said open end and a lower end panel flap connected by a fold line to the bottom panel at said open end, each second fold line being located above an associated first fold line and each minor end panel flap being located above an associated major end panel flap;

providing a recess in each minor end panel flap adjacent an associated major end panel flap;

inserting a plurality of layers of articles into the carrier;

folding the major end panel flaps to form a portion of an end panel of the carrier;

holding adjacent end articles in position by a restraining rail aligned with the recesses in the adjacent minor end panel flaps; and folding the adjacent minor end panel flaps to form another portion of said end panel while the restraining rail remains in place, the recesses in the minor end panel flaps permitting the minor end panel flaps to pivot inwardly past the restraining rail;

portions of the end panels located above the first fold lines tapering outwardly from the top panel.

5. A package comprised of an article carrier containing upper and lower layers of similar adjacent articles arranged in upright position, each article having a relatively narrow top connected by a tapered portion to a relatively wide body, the carrier comprising:

a top panel, a bottom panel, opposite side panels and opposite end panels connected together to form an enclosure for the layers of articles;

each end panel being comprised of two relatively long major end panel flaps, each major end panel flap being connected by a first fold line to a different one of the opposite side panels, two relatively short minor end panel flaps, each minor end panel flap being connected by a second fold line to a different one of the opposite side panels, an upper end panel flap connected by a fold line to the top panel and a lower end panel flap connected by a fold line to the bottom panel;

each second fold line being located above an associated first fold line and each minor end panel flap being located above an associated major end panel flap;

each of the minor end panel flaps including a recess therein, a portion of the associated major end panel flap extending into the recess;

each lower end panel flap overlapping portions of the associated major end panel flaps and being adhered thereto;

each upper end panel flap overlapping portions of the associated major and minor end panel flaps and being adhered thereto; and portions of the end panels located above the first fold lines tapering outwardly from the top panel.

6. A package comprised of an article carrier containing upper and lower layers of similar adjacent articles arranged in upright position, each article having a relatively narrow top connected by a tapered portion to a relatively wide body, the carrier comprising:

a top panel, a bottom panel, opposite side panels and opposite end panels connected together to form an enclosure for the layers of articles;

each end panel being comprised of two relatively long major end panel flaps, each major end panel flap being connected by a first fold line to a different one of the opposite side panels, two relatively short minor end panel flaps, each minor end panel flap being connected by a second fold line to a different one of the opposite side panels, an upper end panel flap connected by a fold line to the top panel and a lower end panel flap connected by a fold line to the bottom panel;

each second fold line being located above an associated first fold line and each minor end panel flap being located above an associated major end panel flap;

each first fold line having an upper end and each second fold line having a lower end, the upper end of each first fold line terminating substantially at the lower end of the associated second fold line;

the lower ends of the second fold lines being adjacent the point at which the substantially tapered portion of an adjacent article in the upper layer joins the relatively wide body thereof;

each lower end panel flap overlapping portions of the associated major end panel flaps and being adhered thereto;

each upper end panel flap overlapping portions of the associated major and minor end panel flaps and being adhered thereto; and portions of the end panels located above the first fold lines tapering outwardly from the top panel.

7. A blank for forming an article carrier for packaging a plurality of layers of similar adjacent articles arranged in upright position, each article having a relatively narrow top connected by a tapered portion to a relatively wide body, comprising:

an interior side panel section having opposite sides;

a top panel section connected by a fold line to one of the sides and a bottom panel section connected by a fold line to the opposite side;

a second side panel section connected by a fold line to one of either the bottom panel section or the top panel section;

each of the panel sections having opposite ends;

an upper end panel flap connected by a fold line to each end of the top panel section;

a lower end panel flap connected by a fold line to each end of the bottom panel section;

a relatively long major end panel flap connected by a first fold line to each end of the side panel sections;

a relatively short minor end panel flap connected by a second fold line to each end of the side panel sections, each minor end panel flap being unconnected to an associated major end panel flap and each second fold line forming a slight outwardly extending angle with an associated first fold line; and each major end panel flap including an edge separating the major end panel flap from an associated minor end panel flap, each major end panel flap also including a further flap connected thereto by a transverse fold line substantially aligned with said edges, the associated minor end panel flap having a recess spaced from adjacent edges of the further flap;

whereby in a carrier formed from the blank each lower end panel flap overlaps portions of the associated major end panel flaps, each upper end panel flap overlaps portions of the associated major and minor end panel flaps, and end panel portions of the carrier formed from the minor end panel flaps taper outwardly from the top panel of the carrier.

8. A blank for forming an article carrier for packaging a plurality of layers of similar adjacent articles arranged in upright position, each article having a relatively narrow top connected by a tapered portion to a relatively wide body, comprising:

an interior side panel section having opposite sides;

a top panel section connected by a fold line to one of the sides and a bottom panel section connected by a fold line to the opposite side;

a second side panel section connected by a fold line to one of either the bottom panel section or the top panel section;

each of the panel sections having opposite ends;

an upper end panel flap connected by a fold line to each end of the top panel section;

a lower end panel flap connected by a fold line to each end of the bottom panel section;

a relatively long major end panel flap connected by a first fold line to each end of the side panel sections; and a relatively short minor end panel flap connected by a second fold line to each end of the side panel sections, each minor end panel flap being unconnected to an associated major end panel flap and each second fold line forming a slight outwardly extending angle with an associated first fold line;

each first fold line and each associated second fold line meeting at a juncture point, each side panel section including a transverse fold line extending between the juncture points on said side panel section, the transverse fold line being substantially parallel to the fold line connecting the interior side panel section to an adjacent top panel section;

the distance between opposite ends of the bottom panel section being greater than the distance between the opposite ends of the top panel section, and the distance between opposite sides of the bottom panel section being greater than the distance between opposite sides of the top panel section;

the side panel section connected to the top panel section including a working fold line spaced from and parallel to the fold line connecting said side panel section to the top panel section, the working fold line extending across the minor end panel flaps connected to said side panel section;

whereby in a carrier formed from the blank each lower end panel flap overlaps portions of the associated major end panel flaps, each upper end panel flap overlaps portions of the associated major and minor end panel flaps, and end panel portions of the carrier formed from the minor end panel flaps taper outwardly from the top panel of the carrier.

* * * * *